US010378210B2

(12) United States Patent
Hayes

(10) Patent No.: US 10,378,210 B2
(45) Date of Patent: Aug. 13, 2019

(54) CONCRETE TENDON GRIPPING AND SEALING APPARATUS AND METHOD

(71) Applicant: PRECISION-HAYES INTERNATIONAL INC., Seagoville, TX (US)

(72) Inventor: Norris Hayes, Katy, TX (US)

(73) Assignee: PRECISION-HAYES INTERNATIONAL INC., Seagoville, TX (US)

( * ) Notice: Subject to any disclaimer, the term of this patent is extended or adjusted under 35 U.S.C. 154(b) by 0 days.

(21) Appl. No.: 15/547,985

(22) PCT Filed: Feb. 2, 2016

(86) PCT No.: PCT/US2016/016139

§ 371 (c)(1),
(2) Date: Aug. 1, 2017

(87) PCT Pub. No.: WO2016/126687

PCT Pub. Date: Aug. 11, 2016

(65) Prior Publication Data

US 2018/0023298 A1 Jan. 25, 2018

Related U.S. Application Data

(60) Provisional application No. 62/110,938, filed on Feb. 2, 2015.

(51) Int. Cl.
*E04C 5/01* (2006.01)
*E04C 5/10* (2006.01)
(Continued)

(52) U.S. Cl.
CPC ..... *E04C 5/12* (2013.01); *E04C 5/10* (2013.01); *E04G 21/12* (2013.01); *E04C 5/015* (2013.01)

(58) Field of Classification Search
CPC ... E04C 5/12; E04C 5/10; E04C 5/015; E04C 5/122; E04G 21/12; Y10T 403/7064
See application file for complete search history.

(56) References Cited

U.S. PATENT DOCUMENTS 3,703,748 A * 11/1972 Kelly ..... E04C 5/122 403/368
6,761,002 B1 7/2004 Sorkin
(Continued)

FOREIGN PATENT DOCUMENTS

DE 19711002 10/1998

OTHER PUBLICATIONS

International Search Report and Written Opinion for Application No. PCT/US2016/016139 dated Jul. 4, 2017 (17 pages).

*Primary Examiner* — Brian D Mattei
(74) *Attorney, Agent, or Firm* — Adolph Locklar

(57) ABSTRACT

Methods and devices for sealing and/or gripping concrete strengthening tendons. Some embodiments provide a method of forming a seal between an encapsulated anchor and a sheath of a tendon engaging the encapsulated anchor. Other embodiments provide a splice for forming a seal around a discontinuity in the sheath of a concrete tensioning tendon. Some embodiments provide a seal assembly for forming a seal between a tubular extension and a sheath of a tendon to protect an exposed portion of the tendon contained within the tubular extension. Some embodiments also provide a method of forming a fluid tight seal between tubular extension and a sheath of a tendon, while other embodiments provide a method of gripping the sheath of a tendon with a tubular extension to prevent the sheath from moving relative to the extension.

18 Claims, 8 Drawing Sheets

(51) Int. Cl.
*E04C 5/12* (2006.01)
*E04G 21/12* (2006.01)

(56) References Cited

U.S. PATENT DOCUMENTS

| | | | | |
|---|---|---|---|---|
| 6,843,031 | B1 * | 1/2005 | Sorkin | E04C 5/08 285/285.1 |
| 6,889,714 | B1 * | 5/2005 | Sorkin | E04C 5/10 138/110 |
| 7,273,238 | B1 | 9/2007 | Sorkin | |
| 7,797,895 | B1 * | 9/2010 | Sorkin | E04C 5/122 403/314 |
| 7,950,196 | B1 * | 5/2011 | Sorkin | E04C 5/10 403/314 |
| 7,950,197 | B1 * | 5/2011 | Sorkin | E04C 5/10 403/314 |
| 8,398,123 | B1 * | 3/2013 | Sorkin | E04C 5/10 285/369 |
| 9,097,014 | B1 * | 8/2015 | Sorkin | E04C 5/122 |
| 2002/0108329 | A1 * | 8/2002 | Bournand | E01D 19/14 52/223.13 |
| 2004/0148882 | A1 * | 8/2004 | Hayes | E04C 5/12 52/223.14 |
| 2008/0302035 | A1 * | 12/2008 | Shin | E02D 5/765 52/223.13 |
| 2016/0369499 | A1 * | 12/2016 | Crumley | E04B 2/16 |
| 2017/0037626 | A1 * | 2/2017 | Sorkin | E04C 5/122 |
| 2017/0081853 | A1 * | 3/2017 | Kim | E04G 21/12 |
| 2017/0350126 | A1 * | 12/2017 | Hunsicker | E04C 5/10 |

* cited by examiner

CONCRETE TENDON GRIPPING AND SEALING APPARATUS AND METHOD

CROSS-REFERENCE TO RELATED APPLICATIONS

This application claims the benefit of prior-filed, U.S. Provisional Patent Application No. 62/110,938, filed Feb. 2, 2015, the entire contents of which are incorporated herein by reference.

BACKGROUND OF THE INVENTION

The use of concrete as a building material is widely known as is its fundamental strength is in compression and its weakness is in tension. It is very desirable in many construction applications to utilize materials which can withstand both compressive and tensile forces. As concrete is typically unable to resist tensile forces, some type of tensile reinforcement must be utilized with the concrete.

Pre-stressed concrete utilizes reinforcement by high strength steel which is pre-stressed within the concrete thereby providing active tensile reinforcement within the concrete versus the passive reinforcement which resulted with the traditional, rebar-reinforced concrete. Such active reinforcement has been found to dramatically extend the range of applications where concrete can be used.

In a typical tendon tensioning anchor assembly used in post-tensioning operations, a pair of anchors is used for anchoring the ends of the tendons suspended there between. In the course of installing the tendon tensioning anchor assembly in a concrete structure, a hydraulic jack or the like is attached to one of the exposed ends of the tendon for applying a predetermined amount of tension to the tendon. When the desired amount of tension is applied to the tendon, a wedge, threaded nuts or the like, are used to capture the tendon and, as the jack is removed from the tendon, to prevent its relaxation and hold it in its stressed condition.

Metallic components within concrete structures may become exposed to many corrosive elements, such as water, de-icing chemicals, sea water, salt water, brackish water, or spray from these sources. Wire cable corrosion is a significant concern in post tension systems. If this occurs, and the exposed portions of the anchor suffer corrosion, then the anchor may become weakened due to this corrosion. The deterioration of the anchor can cause the tendons to slip, thereby losing the compressive effects on the structure, or the anchor can fracture. Also, tendon failure can occur due to water intrusion into the interstices between the tendon and is typically concentrated at tendon ends or anchors. This can cause a premature failure of the post-tensioning system and a deterioration of the structure.

Tendon failure can occurs at portions of the tendon remote from the anchor if it is damaged during installation. The installation of tendons typically occurs in a rugged construction environment where the tendons can be damaged by equipment, careless handling and contact with various site hazards. When the elastomeric sheath is punctured, a water leak path contacting the wire tendon is established. The puncture must be patched to resist water intrusion between the sheath and tendon.

Tendon corrosion typically occurs near the post-tension anchors because the outer sheath is removed from the wire tendon at such locations. To protect the bare wire from corrosion, protective tubes are connected to the anchor and are filled with grease or other corrosion preventative material. This conventional practice is demonstrated by different post-tension systems. Some conventional approaches attempt to create a water tight seal between portions of an encapsulated anchor and the tendon, such as shown in U.S. Pat. Nos. 5,749,185; 6,023,894; and 6,883,280.

Unfortunately, these conventional systems do not prevent water intrusion in all circumstances due to tendons and their sheathing lacking dimensional integrity. Tendons can come from a wide variety of manufactures with large tolerances in outside diameter of the tendon and its protective sheath. Due to the wide variety of tendon dimensions for a nominal size, conventional seal arrangements designed to fit the largest diameter tendons, lack sufficient sealing on lowest diameter tendons of the same nominal thickness. Additional factors potentially causing seal problems include shrinkage and/or other dimensional changes of the sheath, encapsulation, sealing materials, or any combination thereof.

A need exists for an improved post-tension system which better resists corrosion than conventional technology. The system should be compatible with existing installation procedures and should resist the risk of water intrusion into contact with internal tendon wires.

SUMMARY OF THE INVENTION

One aspect of the invention relates to a method of sealing a tubular extension and a sheath of a concrete tensioning tendon. The method includes placing a seal on the sheath; moving the seal adjacent an end of the extension while the extension overlaps a portion of the sheath; and compressing the seal into engagement with the extension and the sheath with a seal activating member to seal the sheath and the extension. The method can further include coupling the seal activating member to a portion of the extension to retain the seal in place, wherein coupling can include threading the seal activing member onto the extension. In some embodiments, the tubular extension is part of an encapsulate anchor assembly. In other embodiments, the tubular extension is part of a splice or patch.

Another aspect of the invention relates to a method of fixing a relative location of a sheath of a concrete tensioning tendon and a tubular extension of a concrete tensioning component. The method includes placing a gripping member on the sheath; moving the gripping member adjacent an end of the extension while the extension overlaps a portion of the sheath; and compressing the gripping member into engagement with the extension and the sheath with a compression member to inhibit relative movement between the sheath and the tubular extension. The method can further include coupling the compression member to a portion of the extension to hold the gripping member in place. In some embodiments, the tubular extension is part of an encapsulate anchor assembly. In other embodiments, the tubular extension is part of a splice or patch.

Another aspect of the invention includes a seal assembly for sealing a tubular extension of a concrete stressing component and a sheath of a concrete stressing tendon. The seal assembly includes a seal dimensioned and configured to extend around a circumference of the sheath and adapted to engage an end of the tubular extension while a portion of the sheath is contained within the tubular extension; and a seal activating member adapted to compress the seal into engagement with the extension and the sheath to seal the sheath and the extension. In some embodiments, the seal includes an annular elastic member such as an o-ring, ferrule, or the like. Also, in some embodiments, the seal activating member includes fastener, which can include a threaded fastener, and more particularly, a self-tapping nut. In some embodiments, the concrete stressing component includes an encapsulated anchor assembly, wherein the extension is coupled to the encapsulated anchor assembly, and wherein the seal assembly inhibits fluid from entering a distal end of the extension relative to the encapsulated anchor assembly. In other embodiments, the concrete stressing component includes a splice, wherein the tubular extension extends over exposed tendon from a first portion of sheath to a second portion of sheath.

Another aspect of the invention relates to a splice for sealing a discontinuity in a sheath of a concrete tensioning tendon. The splice includes a sleeve having a first end, a second end, and a tubular body extending from the first end to the second end; a first seal assembly adapted to be coupled to the first end of the sleeve and seal the first end of the sleeve and the sheath, the first seal assembly adapted to be coupled to the first end of the sleeve and seal the second end of the sleeve and the sheath and a second seal assembly adapted to be coupled to the second end of the sleeve and seal the second end of the sleeve and the sheath. Each seal assembly includes a seal dimensioned and configured extend around the circumference of the sheath and adapted to sealingly engage the end of the sleeve; and a seal fixation member adapted to compress the seal into engagement with the end of the sleeve and the sheath to seal the sheath and the end of the sleeve. Some embodiments include a split sleeve positioned between the sleeve and the sheath.

Another aspect of the invention relates to an encapsulated anchor assembly having a seal with a concrete stressing tendon sheath. The encapsulated anchor assembly including an anchor having a bore adapted to receive and hold a wire tendon in tension; encapsulation substantially surrounding the anchor to inhibit fluid from contacting the anchor, the encapsulation having an extension defining a bore substantially axially aligned with the anchor bore and adapted to receive a portion of the sheath; a compressible seal adapted to engage a distal end of the extension and the sheath; and a compression member adapted to compress the compressible seal into sealing engagement with the distal end of the extension and the sheath. In some embodiments, the compressible seal includes an annular elastic member axially compressed between the extension and the compression member to cause radial deformation of the annular elastic member resulting in engagement with the annular elastic member and the sheath. The annular elastic member can include an o-ring, ferrule-shaped seal, and the like. In some embodiment, the compression member includes a nut threadedly engaged with the extension, application of the threaded engagement causing compression of the annular elastic member between the nut and extension. In some embodiments, the seal is provided with an annular tapered outer surface extending from a largest diameter proximate the rear portion to a smallest diameter proximate the front portion to allow the seal to be wedged between the sheath and the interior surface of the extension. In some embodiments, the interior surface of the extension is provided with an annular tapered surface extending from a largest diameter proximate the end of the extension to a smallest diameter inward from the end of the extension. In some embodiments, the interior surface of the extension is provided with at least one internally projecting circumferential rib proximate the distal end of the extension, the rib being adapted to engage and compress the annular tapered surface of the ferrule against the sheath.

Another aspect of the invention relates to a method of sealing an encapsulated anchor assembly and a sheath of a concrete stressing tendon engaging the encapsulated anchor. The method includes inserting the tendon into the encapsulated anchor, the encapsulated anchor having a main body portion substantially surrounding the anchor and an extension coupled to the main body portion and extending from the main body portion, the main body portion being formed from a first material and the extension being formed from a second material, the second material being substantially more compressible and flexible compared to the first material; arranging the sheath of the tendon to be in an overlapped engagement with the extension; activating a compressing member against the distal end of the extension; and compressing the distal end of the extension against the sheath to form a in response to activating the compressing member. In some embodiments, the compressing member includes a threaded fastener, and wherein activating includes threading the threaded fastener onto the distal end of the extension. In some embodiments, the threaded fastener includes a self-tapping nut having a front portion, a rear portion, and a threaded bore extending between the front portion and the rear portion, the threaded bore having an annular tapered inner surface extending from a largest diameter proximate the front portion to a smallest diameter proximate the rear portion, and wherein compressing includes further threading the front portion of the self-tapping nut onto the distal end of the extension resulting in the annular tapered inner surface of the bore to engage the distal end and increasing compressive force to the distal end with each rotation of the self-tapping nut. In some embodiments, the compressing member includes a band clamp, and wherein activating includes squeezing the band clamp to increase the diameter of the band clamp, positioning the band clamp in a position on the extension in which the extension overlaps the sheath, releasing the band clamp in the position.

Another aspect of the invention relates to a seal assembly for sealing and providing visual indication of a sealing engagement between tubular extension of a concrete stressing component and a sheath of a concrete stressing tendon. The seal assembly includes a seal dimensioned and configured to extend around a circumference of the sheath and adapted to engage an end of the tubular extension while a portion of the sheath is contained within the tubular extension; and a seal activating member adapted to compress the seal into engagement with the extension and the sheath to seal the sheath and the extension, wherein the seal activing member has an at least translucent portion allowing visual indication of compression of the seal by the seal activating member.

Further aspects of the present invention, together with the organization and operation thereof, will become apparent from the following detailed description of the invention when taken in conjunction with the accompanying drawings.

DETAILED DESCRIPTION

Figure 1:
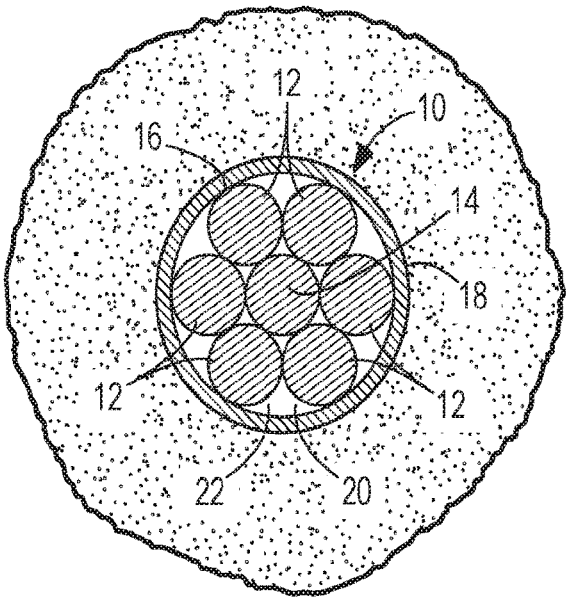
FIG. 1 is an exemplary cross-sectional view of one style of a conventional tendon.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Finally, as described in subsequent paragraphs, the specific mechanical configurations illustrated in the drawings are intended to exemplify embodiments of the invention. Accordingly, other alternative mechanical configurations are possible, and fall within the spirit and scope of the present invention.

One aspect of the present invention relates to improved methods and devices for preventing water intrusion (or other corrosive fluids or elements) on the corrosive core of a tendon when the jacket or sheath around the tendon has been breached. Such breaches can occur in many locations as noted above, and they can happen intentionally, such as at an anchor assembly, or unintentionally, such as unintentional damage to the sheath mid-run (i.e., between anchor assemblies).

FIG. 1 illustrates a sectional view of one particular embodiment of a conventional mono-strand wire tendon 10 used in concrete stressing. The wire tendon is formed with individual wire strands 12 about center wire 14, which are positioned within a sheath 16. One or more wire strands 12 are helically wrapped about center wire strand 14 and form helical grooves on the exterior surface of cable 10. Such helical grooves are cumulatively identified as shaped annulus 18 defining the space between tendon 10 and the interior cylindrical surface of the sheath 16. Tendons are available with slightly different configurations, such as more or less wires, additional sheathing, and different wire construction. The embodiment provided is only for illustration purposes. Other tendon constructions are envisioned for usage with the inventions disclosed herein.

Because wire strands 12 are circular in cross-section, spaces between adjacent wire strands 12 and center wire 14 are cumulatively identified as cable interior interstices 20. As shown in FIG. 1 and known in the art, annulus 18 and interstices 20 are filled with corrosion resistant material 22. Grease or other suitable materials can be used as corrosion resistant material 22 to eliminate air pockets and to resist water intrusion (or other corrosive elements) into contact with wire strands 22. The corrosion resistant material can be utilized as a lubricant as well.

Figure 2:
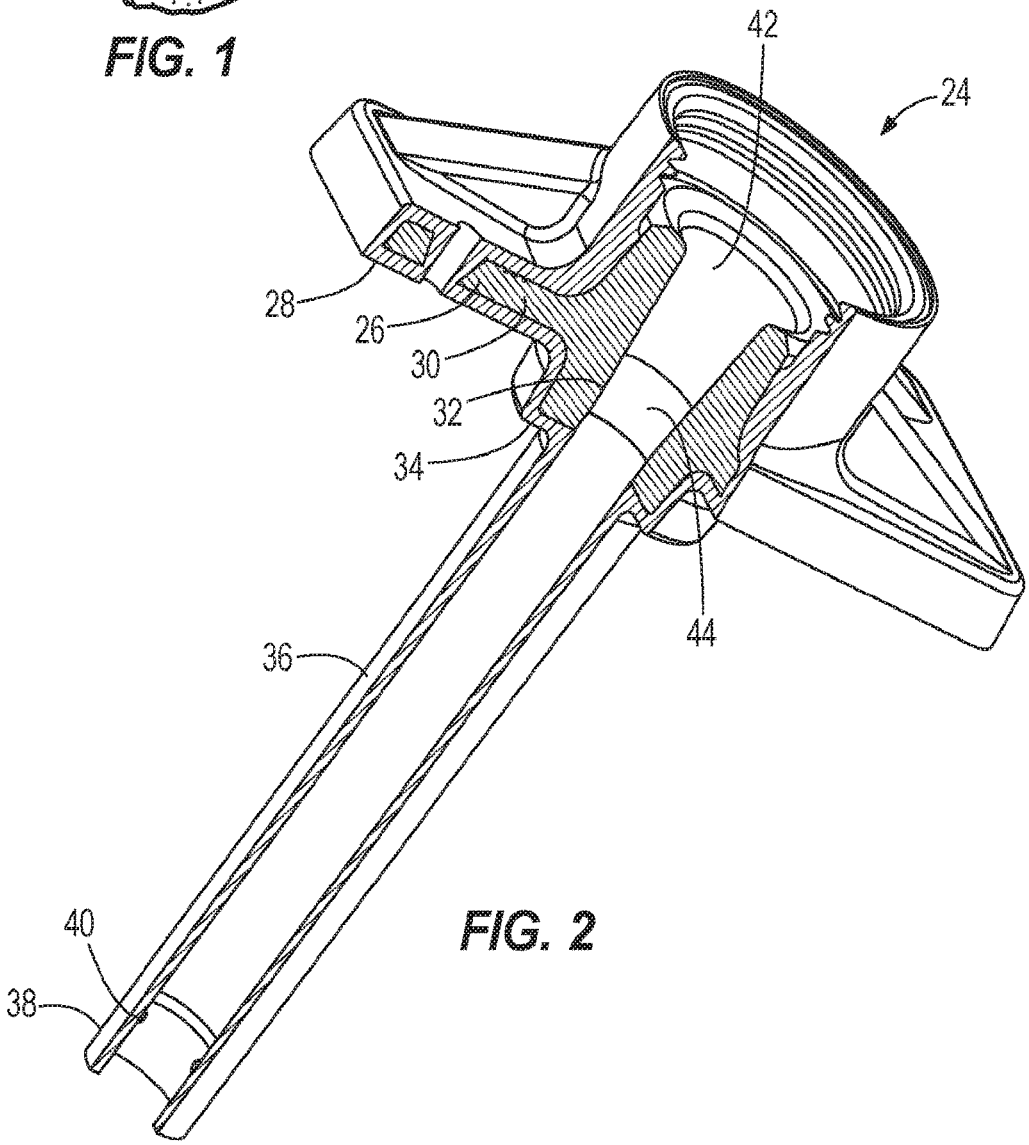
FIG. 2 is an exemplary perspective, cross-sectional view of one style of a conventional encapsulated anchor assembly.

FIG. 2 illustrates a conventional post-tension encapsulated anchor assembly 24 as illustrated in U.S. Pat. No. 6,883,280, which is hereby incorporated by reference for its teachings regarding encapsulated anchor assemblies. The encapsulated anchor assembly 24 includes an anchor body 26 and an encapsulation 28 substantially surrounding the body. The anchor body 26 is typically made from a metallic material such as steel. However, it can be formed with a cast metal material suitable for handling large compressive loads exerted by slips and other fastening devices. The encapsulation 28 is typically a polymeric material.

The anchor body 26 can include many constructions known in the art. As illustrated, the anchor body 26 includes a base 30 having an aperture 32 extending through the base 30.

The encapsulation 28 includes an anchor body portion 34 engaged with the anchor body and cylindrical extension 36 extending from the anchor body 26 to an end 38 distal from base 30. The distal end 38 is preferably at least four inches distal from base 30, however shorter or longer lengths are possible to satisfy the objectives of the invention. In some embodiments, such as shown in U.S. Pat. No. 6,883,280, the extension 36 is integrally molded with the anchor body portion 34 of the encapsulation. In other embodiments, the extension 36 forming the seal with the tendon can be separately coupled to the anchor assembly and be formed of one or more pieces, such as illustrated in U.S. Pat. No. 6,023,894, the teachings of which are hereby incorporated by reference.

As further illustrated in FIG. 2, the inner surface of distal end 38 is preferably circular in cross-section for contacting the exterior surface of the tendon 10 as the tendon 10 is inserted through the cylindrical extension 36 and the base aperture 32. A seal 40 can be positioned between contact end 38 and tendon 10 to restrict liquid intrusion into the inside of cylindrical extension 36. By locating such a seal away from the connection between tendon 10 and the slips, a buffer zone resistant to fluid intrusion is created.

As illustrated, the seal 40 is located on the inner surface of cylindrical extension 36. The seal 40 can be formed an shaped many different ways, as described in U.S. Pat. No. 6,883,280, which is hereby incorporated by reference relative to the construction of the seal. The seal 40 can include one or more rings for contacting the exterior surface of tendon 10 and for providing a liquid tight engagement there between. The ring(s) can comprise a molded feature on an inner surface of cylindrical extension or can comprise a separate component (o-ring) assembled with the contact end 38. The ring(s) can comprise a simple ring feature or can comprise a compound shape. The ring(s) can be angled in a selected direction to facilitate insertion of the tendon 10 there through while resisting withdrawal of the tendon 10 from engagement.

By integrally molding extension 36 into base 30 and by reducing the size of shaped aperture 32, void spaces within the anchor interior are substantially eliminated. An integral extension 36 reduces the zone of encapsulation proximate to engagement between slips and the tendon 10, thereby reducing the possibility of intrusion of corrosive elements into contact with the exposed wire strands 12. Additionally, the extension 36 provides an integral seal connection between base 30 and the exterior surface of the tendon 10. The extension 36 also permits such point of connection to be distal from base 30, thereby providing potential gripping strength over a larger surface area than is possible within the relatively small surface area provided by base 30.

As noted in the Background, conventional extensions 36 with friction fit or interference fit style of seals located near or at the distal end 38 of the extension can fail to provide appropriate sealing engagement or fluid penetration resistance in some situations, which is unacceptable. As discussed above, this problem is prevalent when a tendons thickness is on the lower end of a nominal thickness.

Figure 3:
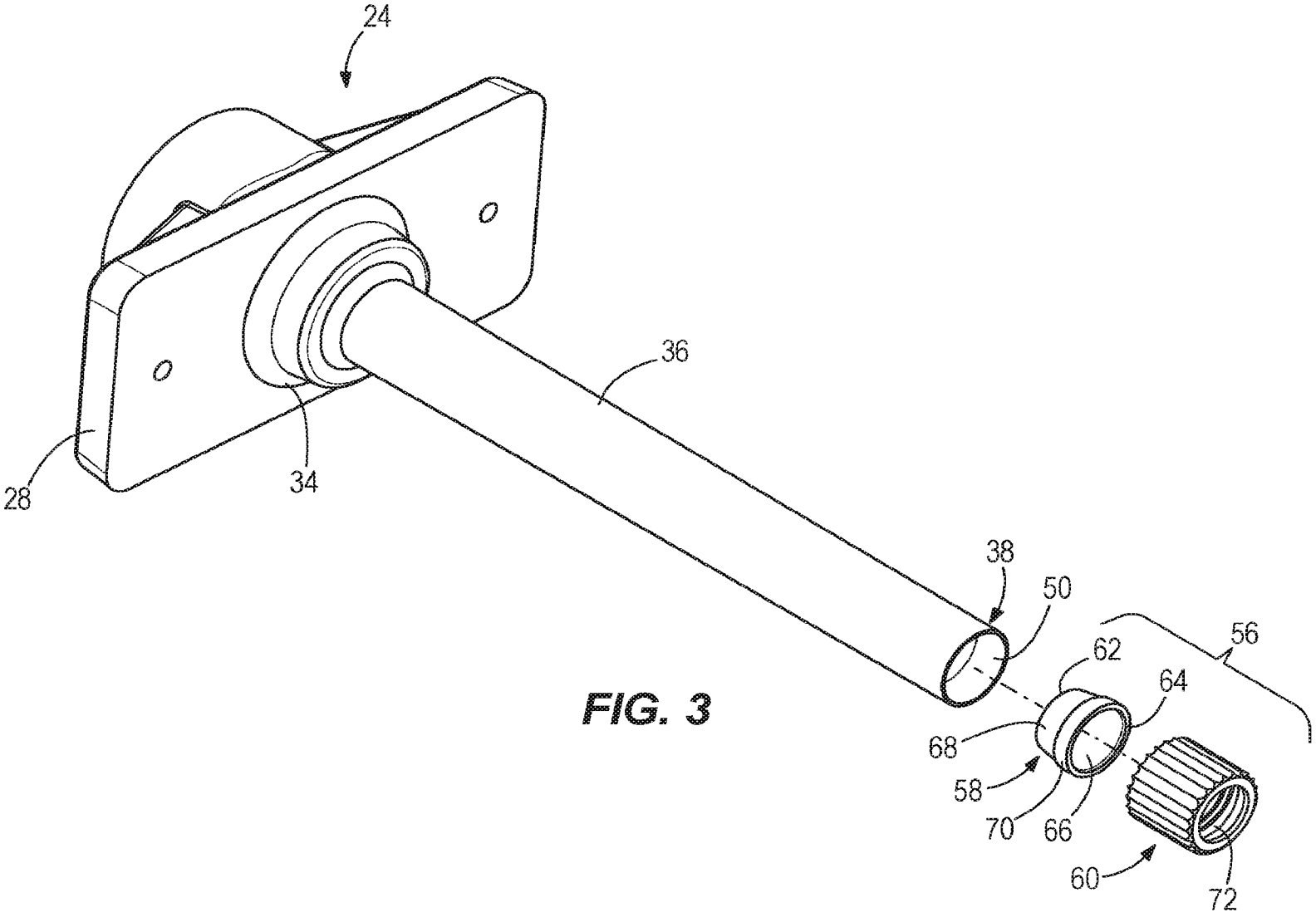
FIG. 3 is an exploded perspective view of an encapsulated anchor assembly embodying aspects of the inventions.

FIG. 3 illustrates one embodiment of a seal assembly 56 contemplated by the present invention in combination with an encapsulated anchor assembly 24. The seal assembly 56 includes a seal member 58 and a seal activation and/or fixation member 60.

Figure 4:
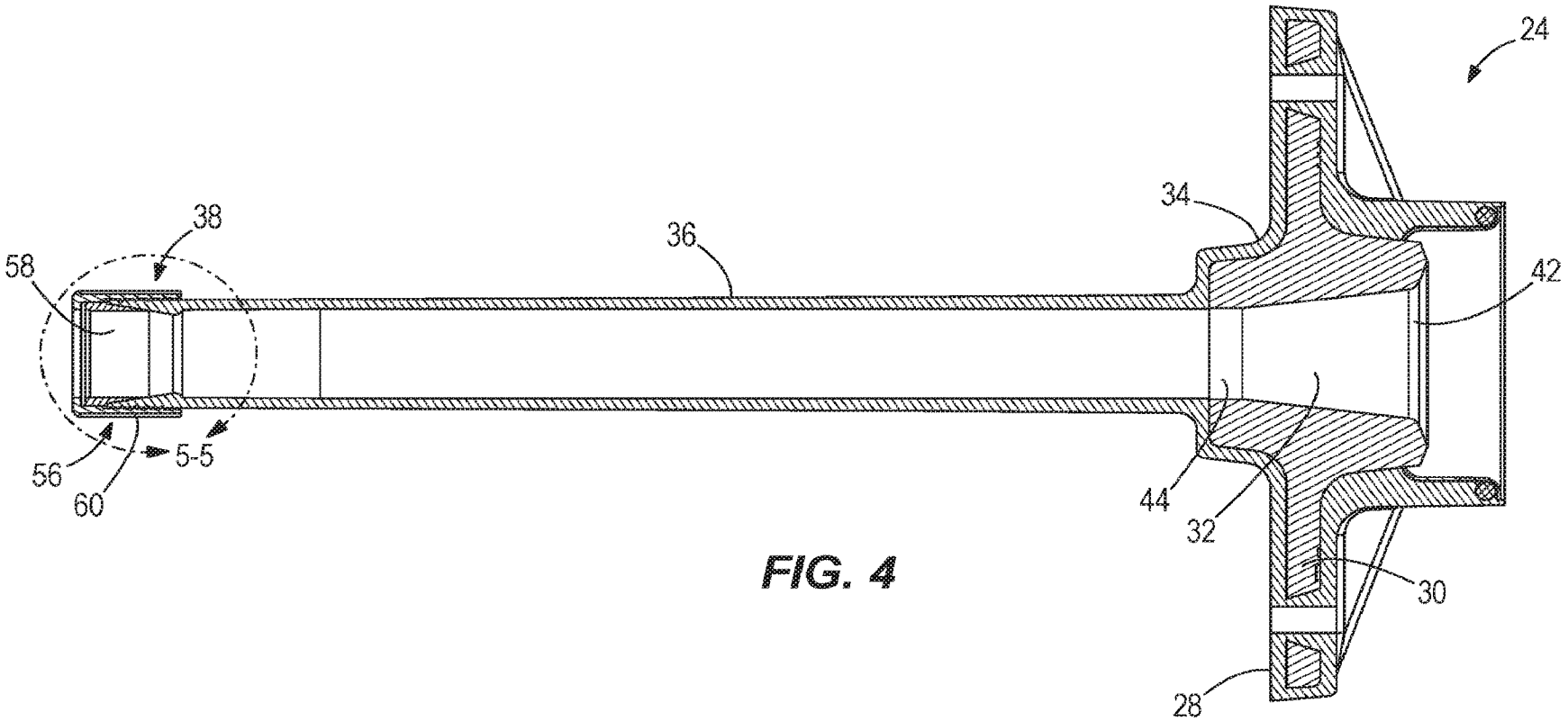
FIG. 4 is a cross-sectional view of an encapsulated anchor assembly of FIG. 3.
Figure 5:
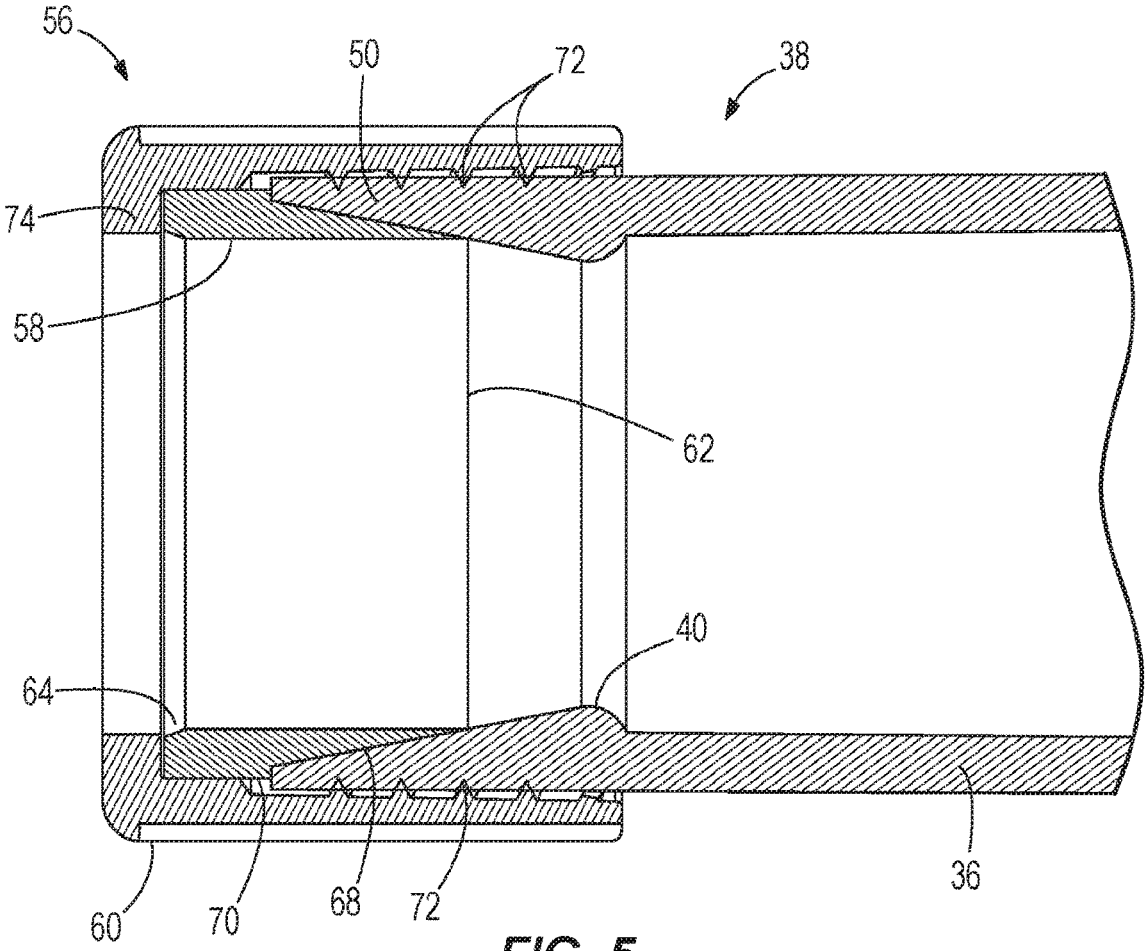
FIG. 5 is a cross-sectional view of Detail A of FIG. 4.

As shown in greater detail in FIGS. 4 and 5, this particular embodiment includes a modification to the distal end 38 of the extension 36. Other embodiments don't require this modification. As illustrated, an annular inner tapered surface 50 is included on the internal surface of the distal end 38 of the extension 36. The taper 50 is created by varying the wall thickness of the distal end 38 the extension 36 to form a tapered surface on the internal surface. In the illustrated embodiment, the outside surface of the extension 36 maintains a substantially constant diameter while the diameter of the inner surface of the extension 36 decreases from the distal end 38 to a positional axially displaced from the distal end 38 to form the taper. In other embodiments, the taper 50 can be created as a separate piece inserted into the extension 36.

As illustrated, the taper 50 can be linear (when viewed in cross-section) or conical in shape. In some embodiments, the taper can be slightly curved (when viewed in cross-section) either parabolic or hyperbolical in shape.

As illustrated, the taper can be positioned at the distal end 38 as illustrated, or it can start slightly inward from the distal end 38. In the illustrated embodiment, the length of the taper in the axial direction stops short of the inner seal 40. In other embodiments, the taper can extend to the seal 40. In such an embodiment, the taper could end at the apex or radially innermost portion of the seal 40. In some embodiments, the inner seal 40 can be eliminated.

In the embodiment illustrated in FIGS. 3-5, a separate seal member 58 is provided. The seal member 58 is shaped and dimensioned to be positioned in the annular void between the sheath 16 of the tendon 10 and the inner surface of the extension 36. Insertion of the seal member 58 between the sheath 16 and the extension 36 causes the seal member to engage the walls of the sheath 16 and extension 36 in a sealing manner to prevent or inhibit fluid intrusion between the sheath 16 and extension 36.

The seal member 58 can be made of many different materials to provide the sealing engagement discussed above. In one embodiment, the seal member 58 is made from elastomeric material such as any rubber material, saturated or unsaturated, or other polymers having rubber-like elasticity.

The seal member 58 can also be configured many different ways. In the illustrated embodiment, the illustrated seal member 58 can be described as an annular seal member, or more particularly an elastomeric ferrule. In other embodiments, as described in greater details below, the seal member 58 can be an o-ring.

As shown in the illustrated embodiment shown in FIGS. 3-5, the ferrule shaped seal member 58 includes a front portion 62 and a rear portion 64. Internally, the ferrule 58 is provided with a bore 66 having a diameter slightly greater than the diameter of the tube of the sheath 16 of the wire tendon 10. Externally, the ferrule 58 is provided with an annular tapered outer surface 68 extending from a largest diameter adjacent the rear portion 64 to a smallest diameter adjacent the front portion 62. The ferrule 58 also has a shoulder 70 at the terminal rear of the ferrule adapted to engage the force applying member 60 as later described in detail.

As illustrated best in FIG. 5, upon assembly, the annular tapered outer surface 68 of the ferrule 58 abuts and engages the annular tapered inner surface 50 of the extension 36. As the ferrule 58 is moved in the axial direction into the distal end 38 of the extension 36 the annular tapered outer surface 68 of the ferrule 58 cams or wedges against the annular tapered inner surface 50 of the extension 36. The further these two items 68 and 50 are placed into engagement with each other, the front portion 62 of the ferrule is deflected or wedged into engagement with the sheath 16 of the tendon 10. Upon full insertion, the shoulder 70 abuts the end of the extension 36 and the elastomeric properties of the ferrule 58 place the ferrule in a sealed interference fit between the extension 36 and the sheath 16 regardless of dimension variations in the outer diameter of the sheath (within reason). Portions of the ferrule 58 are wedged or compressed between the extension 36 and the sheath 16 to form a sealing engagement to inhibit fluid penetration.

In some embodiments, the ferrule 58 is forced between the extension 36 and the sheath 16 with a tool dimensioned and configured to engage the shoulder and apply sufficient force to seat the shoulder 70 against the end of the extension. Such a tool could be semi-circular to extend around the tendon 10 and engage the shoulder 70. A seating force could be applied to the tool and shoulder 70 with a hammer or other similar device. In an embodiment such as this, the friction force created by the interference fit may be sufficient to hold and maintain the fluid tight seal.

In other embodiments, such as the one illustrated in FIGS. 3-5, a separate seal activating/fixation member 60 can be included with the seal assembly 56 in addition to the ferrule seal member 58. In the illustrated embodiment, a nut is threadedly engaged with the extension 36 to active the sealing engagement discussed above and fix or hold the seal in place. The nut 60 is internally threaded 72 for threadedly mounting the nut to the extension 36.

In some embodiments, the extension 36 can be manufactured with corresponding threads for engagement with the nut 60. However, in the illustrated embodiment, only the nut 60 is provided with self-tapping threads 72. As the nut 60 is turned, the self-tapping threads engage the outer surface of the extension 36 and thread into the surface. The nut 60 is provided with a maximum diameter bore of a sufficient dimension to receive and engage the extension 36. The nut 60 of some embodiments, such as is illustrated, is also provided with a radially inwardly extending shoulder 74 adapted to engage the shoulder 70 of the ferrule 58, and the inner diameter of the shoulder slightly greater than the diameter of the tendon 10 sheath 16.

Externally, the nut 60 can include relatively small wrench engaging flats, relatively larger hand engaging flats, or a textured surface for hand engagement and threading. In use in the intended field, workers may be wearing gloves and may have grease on their hands when working with the nut 60. As such, it may be advantageous for hand threading purposes to have an external surface with one or more wings, like a wing nut.

In other embodiments, the seal activation/fixation member 60 can be other activation or fixation devices known in the art. For example, other fasteners, such as threaded fasteners or quick connect devices like a bayonet fitting can be utilized provide either or both functions of activating the seal (i.e., pushing the ferrule into the space between the extension 36 and the tendon 10) and fixing or securing the seal in place. An example of a bayonet fitting can be found in U.S. Pat. No. 2,736,871, the teachings of which are hereby incorporated by reference. Similarly, other quick disconnect fitting can utilized, such as those shown in U.S. Pat. No. 4,343,526 (Quick disconnect assembly); U.S. Pat. No. 3,120,968 (Quick disconnect coupling with ring detent); U.S. Pat. No. 3,773,360 (Snap Lock); U.S. Pat. No. 2,457,523 (Detent Mechanism); and the like, which are all hereby incorporated by reference with respect to their teachings of fixation devices.

Proper engagement of the illustrated seal assembly 56 is accomplished by a predetermined number of revolutions of the compression nut 60 and as the nut 60 is tightened; thus, translating the nut to the right of FIGS. 4 and 5. The shoulder 74 of the nut 60 engages the shoulder 70 of the ferrule 58 thereby forcing the ferrule 58 axially forwardly causing the ferrule annularly tapered surface 68 to engage the annularly tapered inner surface 50 of the extension 36. As the ferrule 58 moves forwardly, the front portion 32 of the ferrule 26 begins to deform inwardly into the sheath 16 due to the camming or wedging engagement between the surfaces 68, 50, and 16. Due to the compression of the ferrule 58 between the inner surface 50 of the extension and the sheath 16, a fluid inhibiting interface is formed between the extension 36 and the sheath 16. Continued tightening of the nut 60 forces the ferrule 58 further forwardly and causes further deformation or compression of the front portion 32 of the ferrule 26 inwardly into a wedge type sealing engagement with the sheath 16, forming the primary seal between the sheath 16 and extension 36. The shoulder portion 70 of the ferrule 58 may also be deformed inwardly (radially) into engagement with the sheath 16 due to compression between the shoulder 74 of the nut 60 and the end of the extension 36, and thereby provide further sealing. Tightening of the nut 60 will be discontinued upon the predetermined number of nut rotations occurring, and at this point a fluid inhibiting seal is established by the seal assembly 56.

Unexpectedly, additional advantageous effects of the illustrated embodiment have been identified. Particularly, it has been discovered that in addition to providing a fluid inhibiting seal, the illustrated embodiment of FIGS. 3-5 also grips and holds (or fixes) the sheath 16 relative to the anchor assembly 24. In other words, the seal assembly 56 prevents the sheath 16 from unexpectedly pulling out of engagement with the anchor assembly 24, which is advantageous on long spans where it is difficult to see both ends of the tendon from a single location.

Prior art references utilizing the internal seals discussed in U.S. Pat. No. 6,883,280 were touted as providing this benefit in addition to providing a sealing, fluid tight engagement. However, in practice, dimensional tolerances of sheathing along with heavy use of lubricious grease for enhanced sealing causes problems with the interference fit design of the prior art. Occasionally, the sheath would be pulled out of engagement with an anchor assembly while performing work at an opposite anchor assembly (100 feet or more away). Once the sheathing is pulled out of the anchor and sealed at the opposite anchor, creating a fluid tight seal can be complex and may require substantial patching, which is not preferred.

Unlike the prior art references relying upon a more passive interference fit (such as seal 40 of FIG. 2), the inventions illustrated in FIGS. 3-5 utilize an active compression fit via a separate compression member that provides significant gripping force to the sheath. In some early prototypes of this invention, the seal assembly 56 has formed a grip that resisted at least 90 pounds of pulling force, which should prevent inadvertent pull-out from the anchor. It is believed that materials and dimensions can be optimized to substantial increase the gripping strength to further resist pull-out. In embodiments where grip is of primary importance, items such as seal assemblies and seals may be referred to as gripping assemblies and grips or gripping members. Grips or gripping members can be made from similar materials and components as the seals discussed above. However, if only grip is of concern, these materials and components may not need to provide a fluid tight engagement.

An additional advantage of the illustrated embodiments is that the seal can be selectively released or disengaged during installation to allow adjustments to be made without wasted materials. This is possible to due to the threaded engagement of the nut. Since tendons are run about one-hundred feet or more at times, adjustments may be needed occasionally on a construction site. Due to the threated engagements and interference fits, the seal assembly 56 can be disengaged from the anchor assembly 24 and reset if necessary.

The embodiment discussed above and illustrated in FIGS. 3-5 provides a taper-on-taper wedge engagement between the ferrule 58 and the interior surface of the extension 36. This provides for a large contact area between the ferrule 58 and the extension 36, which creates a relatively large sealing and gripping engagement.

In alternative embodiments, the taper can be removed from one or more of the surfaces and yet provide a sufficient seal or grip. For example, the annularly tapered outer surface 68 of the ferrule 58 can be eliminated leaving a generally constant diameter outer surface. In use of this modified ferrule, significant portions of the ferrule can be wedged into contact with the extension and compressed against the sheath 16 to form a sufficient fluid tight seal.

In yet another alternative embodiment, the illustrated ferrule 58 can be used with an extension 36 lacking an annularly internal tapered surface 50. Rather, the inner surface could have a generally constant diameter, such as shown in FIG. 2 (with or without seal 40). In operation, the wedge shaped ferrule 58 would create sufficient contact with the extension to compress the ferrule between the sheath and the extension to form a fluid tight seal or grip.

Figure 6:
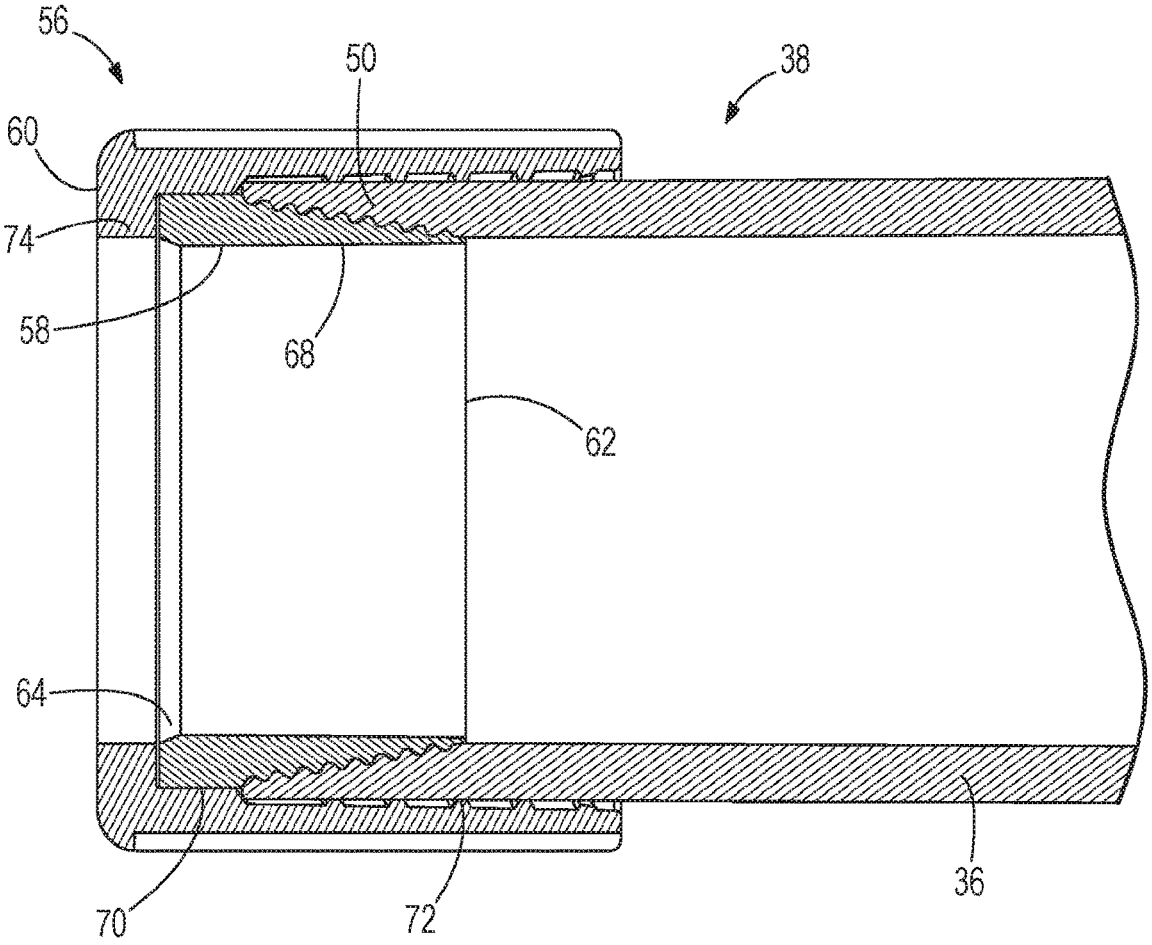
FIG. 6 is a cross-sectional view of an alternative embodiment to that shown in FIG. 5.

In yet another alternative embodiment, the illustrated ferrule 58 can engage one or more integrally molded ribs, such as item 40 of FIG. 2, instead of the annularly tapered internal surface 50 shown in FIGS. 4 and 5. Engagement between the annularly tapered outer surface 68 of the ferrule 58 with a least one rib would create sufficient contact to compress the ferrule between the sheath and the rib to form a fluid tight seal. Additional ribs could create additional sealing interfaces. As shown in FIG. 6, a plurality of ribs can be sized differently to form a discontinuous tapered internal surface on the interior of the extension 36.

The embodiment illustrated in FIGS. 3-5 includes a secondary sealing surface 40 positioned axially inward from the distal end 38 of the extension 36, as discussed above. As noted, this provides a secondary interference fit between projection 40 and the sheath 16. This secondary sealing surface 40 is not necessary for the seal assembly 56 (or variations of it described herein) to properly work. As such, it can be eliminated in some embodiments.

In the illustrated embodiment of FIGS. 3-5, the extension 36 is integrally molded with the anchor main body encapsulation 28. As such, the encapsulation material is one single material. One preferred material is Low Density Polyethylene (LDPE). This material provides favorable properties for threading the nut 60 and compressing the ferrule 58 as the LDPE is fairly rigid and incompressible compared to the elastomeric ferrule 58. This combination of material properties specifically directs the compression primarily to the ferrule 58, which forms the seal/gripping interface between the tendon 10 and the encapsulated anchor assembly 24.

Figure 7:
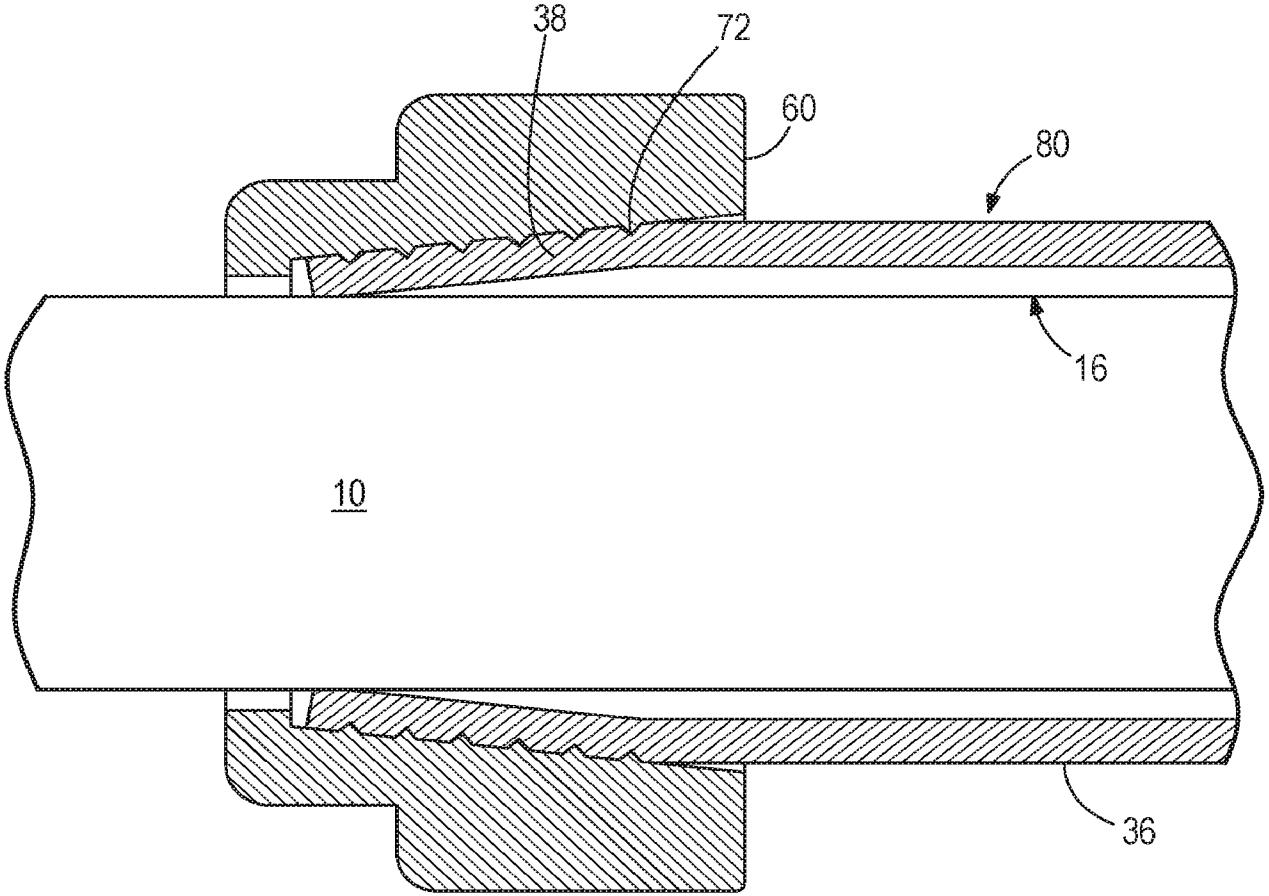
FIG. 7 is a cross-sectional view of an alternative seal assembly embodying aspects of the inventions.

In other embodiments, the extension 36 or portions thereof can be made from a more compressible, more elastomeric material, such as polyurethane or the like, to allow compression of the extension (preferably near the distal end) 36 as shown in FIG. 7. In such an embodiment, the seal member 58 may be eliminated. The seal activating member 60 could simply compress a portion of the extension into the sheath 16 to create a water tight seal between the extension 36 and the tendon sheath 16. Preferably, the material is selected to allow a self-tapping nut to thread onto the end of the extension 36, wherein the nut has an annular tapered inner surface to apply greater compression as the nut is further threaded into engagement. Alternatively, as discussed above, a fitting with similar tapered inner surface but without threads can be used to wedge or cam the end of the extension into sealed engagement with the tendon. Such fittings can many known fixation methods to hold the fitting in place, such as detent engagements, an interference fit between one or more projections with one or more recesses on either the fitting or the projection. In yet another alternative, a fitting with a tapered inner surface (to provide greater compression of the end of the extension with further engagement) can be provided with a series of barbed projections, such as rings, to allow movement in the engagement direction and resist movement via the barbs in the disengagement direction. In some embodiments, compression members like band clamps can also be used.

Figure 8:
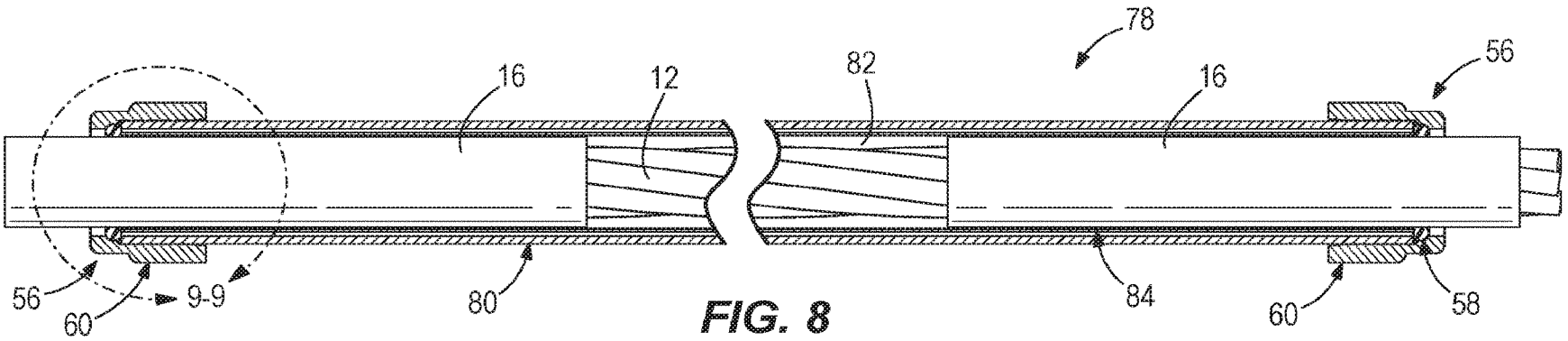
FIG. 8 is a cross-sectional view of sheath splice assembly embodying aspects of the inventions.
Figure 9:
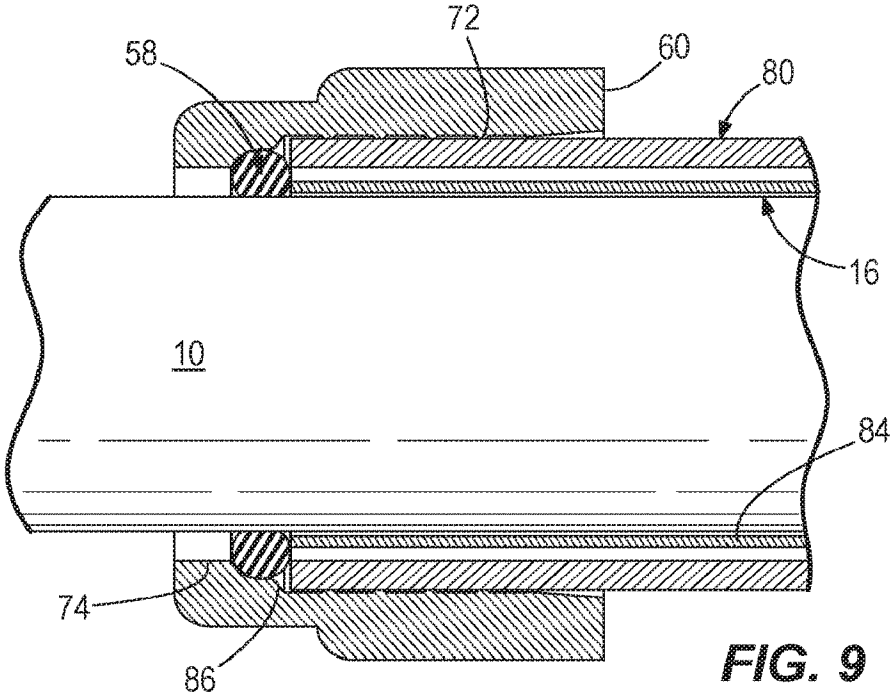
FIG. 9 is a cross-sectional view of Detail A of FIG. 7.

The seal assemblies described above were described primarily within the context of an anchor assembly 24. However, as discussed in the background, patches or splices in the sheath 16 may be required at any position outside the anchor assembly for many different reasons. These patches or splices have the same requirement as encapsulated anchor assemblies to prevent fluid intrusion to the wires 12 and 14 of the tendon 10. Therefore, all of the above referenced seal assemblies can be utilized in a patch or splice 78 that utilizes a sleeve 80 (similar to extension 36) to patch openings in the sheath 16 or splice together adjacent sections of sheath 16 as shown in FIGS. 8 and 9. In such a situation, as illustrated, a seal assembly 56 would be used on each end of the tubular body to seal each end.

As illustrated in the embodiment shown in FIGS. 8 and 9, the patch or splice assembly 78 includes a sleeve 80 covering the discontinuity 82 in the sheath 16 and a seal assembly 56 coupled to each end of the sleeve 80 to form a fluid tight seal between the sleeve 80 and the sheath 16 of the tendon 10. In some embodiments, such as the illustrated embodiment, a secondary sleeve 84 positioned inside the sleeve 80 can also be incorporated to enhance the seal as described in greater detail below.

As shown in the illustrations, the sleeve 80 has a generally tubular shaped body that extends a sufficient distance to appropriately cover or bridge a discontinuity 82 in the sheath 16 of the tendon 10. Depending upon whether the sleeve 80 is merely covering a small puncture in the sheath 16 or substantial gap between two adjacent sections of sheathing (possibly incorrectly cut near an anchor), the length of the sleeve can vary. The diameter of the sleeve 80 can vary depending upon the application and/or materials utilized (discussed below). However, the inside diameter should be only slightly larger than the diameter of the sheath 16. Due to the dimensional variability of commercially available sheaths, the diameter should be selected to accommodate the upper end of available diameters for the nominal thickness of the tendon 10 used. Generally, the sleeve will have a diameter similar to known extensions of encapsulated anchor assemblies commercially available.

Like the extension 36 of the encapsulated anchor assemblies of FIGS. 1-7, the sleeve can be formed from a wide variety of materials having different material properties (i.e., rigidity, strength, compressibility, etc.) depending upon either the application or the seal assembly 56 utilized. For example, due to the seal member 58 being incorporated in the illustrated seal assembly 56, a stronger, more rigid, and less compressible material like LDPE can be used. This material has advantages compared to other more compressible materials discussed above. In particular, if the sleeve needs to be slid over a relatively long run of tendon (and sheath) to be put in place, a more rigid material like LDPE can be slid easier that softer, more elastic or rubbery materials while holding substantially tighter dimensions relative to the sheath engaged. In other words, if relatively rigid sleeve and a softer, more flexible sleeve have identical dimensions in close approximation of the outside diameter of the sheath 16, the softer, more flexible sleeve is more likely to get caught or hung up on the sheath while being slid along the tendon from the free end of the tendon to the place of the discontinuity. However, in some embodiments, a sleeve having a more flexible and compressible material may be desirable.

Although it is not always required, some embodiments, like the illustrated embodiment of FIGS. 8 and 9 can utilize a secondary sleeve 84. The construction of the secondary sleeve 84 is quite similar to the sleeve 80 except the secondary sleeve 84 is a split sleeve. In other words, a split or slit extends from one end of the secondary sleeve 84 to the other end of the split sleeve 84. In a preferred embodiment, the slit extents in a generally longitudinal direction from end to end. However, in other embodiments, the split can be configured differently, such as by being angled along the length, spiraled along the length, or other known ways of splitting.

The split sleeve 84 provides a few advantages over the external sleeve 80. First, it does not have to be slid along the length of the tendon 10 to be moved into position over the discontinuity 82 in the tendon 10. Rather, the split allows the split sleeve 84 to be opened up sufficiently to fit around the tendon 10 at the discontinuity 82 and elastically return to its original shape to substantially enclose the tendon 10. Second, due to this split arrangement, the split sleeve can provided with an inner diameter much closer in approximation to the out diameter of the tendon sheath 16. The split allows the split sleeve 84 to absorb dimensional integrity issues of the sheath on commercially available tendons. Due to the elasticity of the split sleeve and the relatively thin wall thickness of it, the split sleeve can be dimensioned to snuggly engage the smallest diameter sheath (within a nominal diameter range) by allowing the ends defined by opposite sides of the split to overlap. When applied to the largest diameter sheath (within the same nominal diameter range), the ends defined by opposite sides of the split preferably resiliently return to a position where they are touching each other.

Like the outer sleeve 80, the split sleeve 84 can be made from a wide variety of materials. In one embodiment, the split sleeve 84 is made from LDPE for its elastic resilience, wherein when the sleeve is split it tends to partially spool around itself or otherwise overlap in the absence of a tendon. Other materials with similar properties can be utilized as well. In yet other embodiments, materials with different properties can be used as well. For example, if a more rubbery material lacking the elastic resilience described above is used, it can be adhered in place to provide an inner sleeve. In some embodiments, a sheet of material can be coupled to the tendon and wrapped around the tendon in a mating or overlapping arrangement. In yet other embodiments, tape can be continuously wrapped around the tendon in place of the split sleeve.

In operation, it is preferred to have corrosion inhibiting material, such as grease, applied to the discontinuity 82 in the sheath 16 before applying either the sleeve 80 or split sleeve 84, if applicable. More preferably, the corrosion inhibiting material is applied not only to the exposed wires 12 of the tendon 10, but also to the sheath 16 extending along the length of the splice. In embodiments that utilize the split sleeve, it may be desirable to apply corrosion inhibiting material along the length of the split as well. Alternatively, the corrosion inhibiting material can be applied on the entire outer surface of the split sleeve to further prevent fluid intrusion into the discontinuity.

As discussed above and shown in FIGS. 6 and 7, the splice assembly 78 includes a seal assembly 56 at each end of the sleeve 80. Any of the sealing arrangements discussed above with respect to FIGS. 3-7 can be utilized in place of the seal assembly illustrated in FIGS. 8 and 9 to achieve the fluid tight seal desired over the length of the splice assembly 78. Similarly, the seal assembly 56 illustrated in FIGS. 8 and 9 can be utilized on the distal end 38 of the extension 36 of an encapsulated anchor assembly 24 to provide a fluid tight seal. The description provided below is only one exemplary embodiment of a seal assembly.

In the embodiment illustrated in FIGS. 8 and 9, a separate seal member 58 is provided. The seal member 58 is shaped and dimensioned to be positioned between the end of the sleeve(s) 80 (84) and a portion of a seal activating member 60 to provide a sealing engagement between the sheath 16 of the tendon 10, the end of the sleeve(s) 80 (84), and the seal activating member 60.

The seal member 58 can be made of many different materials to provide the sealing engagement discussed above. In one embodiment, the seal member 58 is made from elastomeric material such as any rubber material, saturated or unsaturated, or other polymers having rubber-like elasticity and compressibility.

The seal member 58 can also be configured many different ways. In the illustrated embodiment, the illustrated seal member 58 can be described as an annular seal member, or more particularly an o-ring. In other embodiments, as described in greater details below, the seal member 58 can be an x-ring, diaphragm, rubber washer, ferrule, tapered ferrule as discussed above, or other elastically deformable interface.

As further illustrated in FIGS. 8 and 9, a separate seal activating/fixation member 60 is provided to compress the seal member 58 into sealing engagement with the sheath 16. In particular, a nut is used in the illustrated embodiment to activate the seal by compressing the o-ring and fix the seal in place via a threaded engagement.

The nut 60 is internally threaded 72 for threadedly mounting the nut to the sleeve 80. In some embodiments, the sleeve 80 can be manufactured with corresponding threads for engagement with the nut 60. However, in the illustrated embodiment, only the nut 60 is provided with self-tapping threads 72. As the nut 60 is turned, the self-tapping threads engage the outer surface of the sleeve 80 and thread into the outer surface of the sleeve 80.

The nut 60 is provided with a maximum diameter bore of a sufficient dimension to receive and engage the sleeve 80. The nut 60 is also provided with a radially inwardly extending shoulder 74 adapted to engage the o-ring 58, and the inner diameter of the shoulder slightly greater than the diameter of the tendon 10 sheath 16. As illustrated, the shoulder of this embodiment has a fillet between the shoulder and main body of the nut for better seating of the o-ring against the nut and direct most compression of the o-ring towards the sheath.

The illustrated nut 60 also has a flange 86. This flange 86 limits the threading engagement of the nut 60 on the sleeve 80. In the illustrated embodiment, it can provide a benefit of preventing too much compression on the o-ring 56. Due to the size of the illustrated inner bore of the nut 60, it may be possible for the o-ring to be compressed to a point where the o-ring begins to extrude through the inner bore, which could result in a seal failure. In other embodiments, the inner diameter of the nut bore can more closely match the outer diameter of the sheath. In such embodiments, the flange 86 may not be necessary.

Externally, the nut 60 can include relatively small wrench engaging flats, relatively larger hand engaging flats, or a textured surface for hand engagement and threading. In use in the intended field, workers may be wearing gloves and may have grease on their hands when working with the nut 60. As such, it may be advantageous for hand threading purposes to have an external surface with two of more wings, like a wing nut.

In other embodiments, the seal activation/fixation member 60 can be other activation or fixation devices known in the art. For example, other fasteners, such as threaded fasteners or quick connect devices like a bayonet fitting can be utilized provide either or both functions of activating the seal (i.e., compressing the o-ring into sealed engagement with the tendon 10) and fixing the seal in place. An example of a bayonet fitting can be found in U.S. Pat. No. 2,736,871, the teachings of which are hereby incorporated by reference. Similarly, other quick disconnect fitting can utilized, such as those shown in U.S. Pat. No. 4,343,526 (Quick disconnect assembly); U.S. Pat. No. 3,120,968 (Quick disconnect coupling with ring detent); U.S. Pat. No. 3,773,360 (Snap Lock); U.S. Pat. No. 2,457,523 (Detent Mechanism); and the like, which are all hereby incorporated by reference with respect to their teachings of fixation devices.

Proper engagement of the illustrated seal assembly 56 is accomplished by a predetermined number of revolutions of the compression nut 60 and as the nut 60 is tightened; thus, translating the nut to the right of FIG. 9. The shoulder 74 of the nut 60 engages the o-ring 58 thereby forces the o-ring 58 against the end of the sleeve 80. As the nut 60 continues to move forwardly, o-ring begins to be compressed between the nut 60 and the sleeve 80. This in turn causes the o-ring to deform inwardly into the sheath 16 as shown in FIG. 9 (flat portion of o-ring) and thereby forming a sealing relationship between the nut 60, the sleeve 80, and the sheath 16. Tightening of the nut 60 will be discontinued upon the flange 86 of the nut 60 engaging the end of the sleeve 80, and at this point a fluid inhibiting seal is established by the seal assembly 56.

Figure 10A:
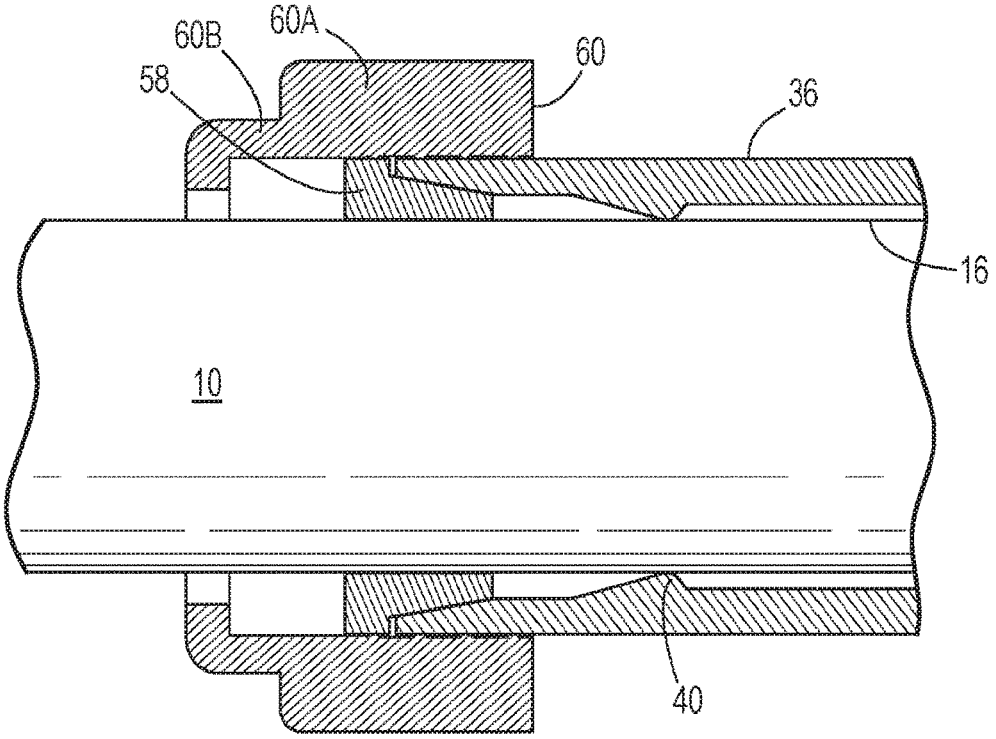
FIGS. 10A and 10B are cross-sectional views of an alternative seal assembly embodying aspects of the inventions.
Figure 10B:
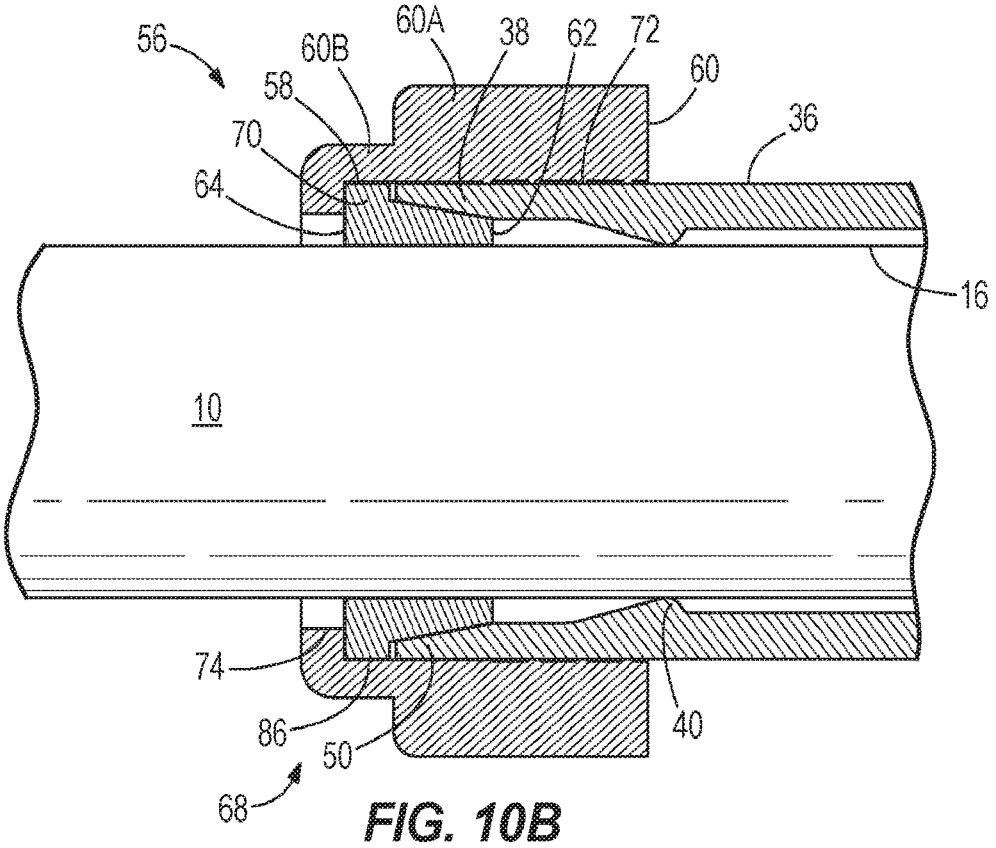

FIGS. 10A & 10B illustrate an alternative embodiment of a seal assembly 56 contemplated by the present invention. The seal assembly 56 includes a seal member 58 and a seal activation and/or fixation member 60. Like the seal assembly of the previous embodiments, this seal assembly 56 is adapted to engage the distal end 38 of the extension 36 of an encapsulated anchor or the end of a splice.

Like the embodiment shown in FIGS. 3-5, the illustrated seal member of this embodiment is a ferrule shaped seal member 58 including a front portion 62 and a rear portion 64. Internally, the ferrule 58 is provided with a bore having a diameter slightly greater than the diameter of the sheath 16 of the wire tendon 10. Externally, the ferrule 58 is provided with an annular tapered outer surface 68 extending from a largest diameter adjacent the rear portion 64 to a smallest diameter adjacent the front portion 62. The ferrule 58 also has a shoulder 70 at the terminal rear of the ferrule adapted to engage the force applying member 60 as later described in detail.

As illustrated best in FIG. 10B, upon assembly, the annular tapered outer surface 68 of the ferrule 58 abuts and engages the annular tapered inner surface 50 of the extension 36. As the ferrule 58 is moved in the axial direction into the distal end 38 of the extension 36 the annular tapered outer surface 68 of the ferrule 58 cams or wedges against the annular tapered inner surface 50 of the extension 36. The further these two items 68 and 50 are placed into engagement with each other, the front portion 62 of the ferrule is deflected or wedged into engagement with the sheath 16 of the tendon 10. Upon full insertion, the shoulder 70 abuts the end of the extension 36 and the elastomeric properties of the ferrule 58 place the ferrule in a sealed interference fit between the extension 36 and the sheath 16 regardless of dimension variations in the outer diameter of the sheath (within reason). Portions of the ferrule 58 are wedged or compressed between the extension 36 and the sheath 16 to form a sealing engagement to inhibit fluid penetration.

As illustrated in FIGS. 10A and 10B, a seal activating/fixation member 60, such as a nut, is threadedly engaged with the extension 36 to activate the sealing engagement discussed above and fix or hold the seal in place. The nut 60 is internally threaded 72 for threadedly mounting the nut to the extension 36. In some embodiments, the extension 36 can be manufactured with corresponding threads for engagement with the nut 60. However, in the illustrated embodiment, only the nut 60 is provided with self-tapping threads 72. As the nut 60 is turned, the self-tapping threads engage the outer surface of the extension 36 and thread into the surface. The nut 60 is provided with a maximum diameter bore of a sufficient dimension to receive and engage the extension 36. The nut 60 of some embodiments, such as is illustrated, is also provided with a radially inwardly extending shoulder 74 adapted to engage the shoulder 70 of the ferrule 58, and the inner diameter of the shoulder slightly greater than the diameter of the tendon 10 sheath 16.

Externally, the nut 60 can include relatively small wrench engaging flats, relatively larger hand engaging flats, or a textured surface for hand engagement and threading. In use in the intended field, workers may be wearing gloves and may have grease on their hands when working with the nut 60. As such, it may be advantageous for hand threading purposes to have an external surface with one or more wings, like a wing nut.

Proper engagement of the illustrated seal assembly 56 is accomplished by a predetermined number of revolutions of the compression nut 60 and as the nut 60 is tightened; thus, translating the nut to the right of FIGS. 10A and 10B. The shoulder 74 of the nut 60 engages the shoulder 70 of the ferrule 58 thereby forcing the ferrule 58 axially forwardly causing the ferrule annularly tapered surface 68 to engage the annularly tapered inner surface 50 of the extension 36. As the ferrule 58 moves forwardly, the front portion 32 of the ferrule 26 begins to deform inwardly into the sheath 16 due to the camming or wedging engagement between the surfaces 68, 50, and 16. Due to the compression of the ferrule 58 between the inner surface 50 of the extension and the sheath 16, a fluid inhibiting interface is formed between the extension 36 and the sheath 16. Continued tightening of the nut 60 forces the ferrule 58 further forwardly and causes further deformation or compression of the front portion 32 of the ferrule 26 inwardly into a wedge type sealing engagement with the sheath 16, forming the primary seal between the sheath 16 and extension 36. The shoulder portion 70 of the ferrule 58 may also be deformed inwardly (radially) into engagement with the sheath 16 due to compression between the shoulder 74 of the nut 60 and the end of the extension 36, and thereby provide further sealing. Tightening of the nut 60 will be discontinued upon the predetermined number of nut rotations occurring, and at this point a fluid inhibiting seal is established by the seal assembly 56.

Due to the forces (i.e., friction from tapping and seal compression) exerted on the nut 60, it may be difficult with some embodiments to determine if the nut has rotated sufficiently to generate a proper seal. As such, the seal assembly 56 of this embodiment provides a visual indicator of proper engagement. As described in greater detail below, the visual indicator of the illustrated embodiment is on the seal activation and/or fixation member 60.

As shown in FIGS. 10A and 10B, the seal activation and/or fixation member 60 of this embodiment includes a seal indicator 60B. In the illustrated embodiment, the seal indicator 60B comprises a portion with at least translucent material adjacent the end of the nut 60. As used herein, the term "at least translucent" means transmitting and diffusing light so that objects can at least partially be viewed, which can include transparent within the meaning. In other words, this definition does not include opaque, which blocks the passage of light. The translucent material provides visual indication of proper sealing engagement when the shoulder 70 of the ferrule 58 is properly engaged by the shoulder 74 of the nut. Through the use of translucent materials on at least a portion of this area of the nut, visual indication can be provided when the shoulders 74, 70 are properly positioned.

In some embodiments, the portion of at least translucent material 60B is a window molded into either the axially extending portion of the seal shoulder engaging area of the nut or the radially extending portion of the seal shoulder engaging area. The window should be at least translucent. However, in some embodiments, it can also be made of generally transparent materials.

In the illustrated embodiment, the visual indication is provided by molding the entire shoulder engaging area of the nut 60 from a single material that is at least translucent. Depending upon the choice of material used, this area can be made generally transparent if desired. In some embodiments, such as the illustrated embodiment of FIGS. 10A and 10B, the threaded area 60A of the nut 60 is also modeled from the same at least translucent material. However, in other embodiments, the threaded area 60A of the nut 60 can be made from other materials, including opaque materials.

As noted above, in some embodiments, the entire nut 60 is at least translucent. In such an embodiment, the end of the seal 58 extending beyond tube 36 can be observed along the threaded portion 60A of the nut 60 as the nut 60 is tightened and secured from the position shown in 10A to the position shown in 10B. Once the seal 58 is viewed in the seal indicating portion 60B (FIG. 10B), one knows that the nut 60 is fully threaded onto the tube 36 to form a proper sealing engagement.

In some embodiments, the seal 58 can be more easily seen through a translucent body through the use of a colored seal. For example, very bright colors, such as red, orange, bright green, etc., may transmit quite well through a generally white plastic translucent nut 60. In other embodiments, very dark seal colors, such as black or blue, may also transmit light (or shadows) well through certain translucent materials. In yet other embodiments, the seal 58 is a first color when not sealed and a second color when sealed (i.e., under sufficient compression by the shoulders).

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

What is claimed is:

1. A seal assembly for sealing a tubular extension of a concrete stressing component and a sheath of a concrete stressing tendon, the seal assembly comprising:

a seal dimensioned and configured to extend around a circumference of the sheath and adapted to engage an end portion of the tubular extension while a portion of the sheath is contained within the tubular extension, the tubular extension being integrally formed with an encapsulation of the concrete stressing component, wherein the seal comprises an elastic member having a front portion, a rear portion, an outer shoulder at the rear portion, a tapered outer surface extending from a largest diameter proximate the rear portion to a smallest diameter proximate the front portion, and a bore extending from the front portion to the rear portion, the bore being dimensioned to be received on the sheath, the front portion being at least partially receivable in the tubular extension; and a seal activating member adapted to compress the seal into engagement with the extension and the sheath to seal the sheath and the extension, the seal activating member activating member engaging the outer shoulder and adapted to bias the outer shoulder against an end surface of the extension;

wherein the shoulder is adapted to engage the seal activating member so as to force the front portion between the sheath and the interior surface of the tubular extension and radially compress the front portion between the sheath and the interior surface of the tubular extension, thereby resulting in a sealing engagement between the elastic member and the sheath.

2. The seal assembly of claim 1, wherein the seal activating member includes a nut threadedly coupled to the tubular extension to cause compression of the seal between the nut and extension.

3. The seal assembly of claim 2, wherein the nut includes a self-tapping nut.

4. The seal assembly of claim 1, wherein the concrete stressing component includes an encapsulated anchor assembly, wherein the extension is coupled to the encapsulated anchor assembly, and wherein the seal assembly inhibits fluid from entering a distal end of the extension relative to the encapsulated anchor assembly.

5. The seal assembly of claim 1, wherein the concrete stressing component includes a splice, wherein the tubular extension extends over exposed tendon from a first portion of sheath to a second portion of sheath, wherein the seal is a first seal and the seal activating member is a first seal activating member, and wherein the seal assembly further comprises: a second seal dimensioned and configured extend around the circumference of the sheath and adapted to engage a second end of the tubular extension while a portion of the sheath is contained within the tubular extension; a second seal activating member adapted to compress the second seal into engagement with the extension and the sheath to seal the sheath and the extension.

6. The seal assembly of claim 1 wherein the seal activating member has an at least translucent portion allowing visual indication of compression of the seal by the seal activating member.

7. The seal assembly of claim 6, further comprising a threaded area of a nut modeled from an at least translucent material.

8. The seal assembly of claim 6, wherein the seal is a colored seal.

9. The seal assembly of claim 6, wherein the seal is a first color when the seal is not compressed and a second col or when the seal is compressed.

10. The anchor assembly of claim 1, wherein the seal is selectively releasable from the anchor assembly.

11. The anchor assembly of claim 1, wherein the seal activating member has an at least translucent portion allowing visual indication of compression of the seal by the seal activating member.

12. The seal assembly of claim 1 wherein the interior surface of the extension is provided with an annular tapered surface extending from a largest diameter proximate an end of the extension to a smallest diameter inward from the end of the extension, the annular tapered outer surface of the seal engaging the annular tapered surface of the extension in a camming manner to compress the seal and to seal the sheath and the extension.

13. A seal assembly for sealing a tubular extension of a concrete stressing component and a sheath of a concrete stressing tendon, the seal assembly comprising:

a seal dimensioned and configured to extend around a circumference of the sheath and adapted to engage an end portion of the tubular extension while a portion of the sheath is contained within the tubular extension, the tubular extension being integrally formed with an encapsulation of the concrete stressing component, the seal including an outer shoulder positioned adjacent a terminal end of the seal; and a seal activating member adapted to compress the seal into engagement with the extension and the sheath to seal the sheath and the extension, the seal activating member activating member engaging the outer shoulder and adapted to bias the outer shoulder against an end surface of the extension;

wherein the seal includes an annular elastic member axially compressed between the tubular extension and the seal activating member to cause radial deformation of the annular elastic member thereby resulting in sealing engagement with the annular elastic member and the sheath; and wherein the annular elastic member includes a ferrule-shaped seal having a front portion, a rear portion, and a bore extending from the front portion to the rear portion, the bore being dimensioned to be received on the sheath, the front portion being at least partially receivable inside the extension, the shoulder positioned at the rear portion, the shoulder of the seal being adapted to engage the seal activating member to force the front portion of the ferrule between the sheath and the interior surface of the extension and compress the front portion between the sheath and the interior surface of the extension to seal the sheath and the extension.

14. The seal assembly of claim 13, wherein the seal activating member is operable to compress the shoulder of the seal between the seal activating member and the end surface of the extension, and wherein the seal activating member is further adapted to hold the shoulder in this compressed state.

15. The seal assembly of claim 14, wherein the seal activating member includes a nut that threadedly engages the extension.

16. The seal assembly of claim 13, wherein the ferrule-shaped seal is provided with an annular tapered outer surface extending from a largest diameter proximate the rear portion to a smallest diameter proximate the front portion to allow the seal to be wedged between the sheath and the interior surface of the extension.

17. The seal assembly of claim 16, wherein the interior surface of the extension is provided with an annular tapered surface extending from a largest diameter proximate an end of the extension to a smallest diameter inward from the end of the extension, the annular tapered outer surface of the seal engaging the annular tapered surface of the extension in a camming manner to compress the seal and to seal the sheath and the extension.

18. The seal assembly of claim 13, wherein the interior surface of the extension is provided with an annular tapered surface extending from a largest diameter proximate an end of the extension to a smallest diameter inward from the end of the extension, the annular tapered outer surface of the seal engaging the annular tapered surface of the extension in a camming manner to compress the seal and to seal the sheath and the extension.

* * * * *